United States Patent [19]

Myers et al.

[11] Patent Number: 4,787,778

[45] Date of Patent: Nov. 29, 1988

[54] METHOD AND APPARATUS FOR TENSIONING A RISER

[75] Inventors: Roderick J. Myers; Jorge H. Delgado, both of Houston, Tex.

[73] Assignee: Conoco Inc., Ponca City, Okla.

[21] Appl. No.: 41,904

[22] Filed: Apr. 24, 1987

Related U.S. Application Data

[63] Continuation-in-part of Ser. No. 936,579, Dec. 1, 1986, Pat. No. 4,733,991.

[51] Int. Cl.[4] ..... E21B 43/01

[52] U.S. Cl. ..... 405/195; 166/367; 175/5

[58] Field of Search ..... 405/195, 202, 224; 175/5, 8, 9; 166/359, 367; 114/264, 265

[56] References Cited

U.S. PATENT DOCUMENTS

| | | | |
|---|---|---|---|
| 3,508,409 | 4/1970 | Cargile, Jr. | 61/46.5 |
| 3,984,990 | 10/1976 | Jones | 61/99 |
| 4,004,532 | 1/1977 | Reynolds | 175/5 X |
| 4,198,179 | 4/1980 | Pease et al. | 405/195 |
| 4,215,950 | 8/1980 | Stevenson | 405/195 |
| 4,362,438 | 12/1982 | Spink | 405/195 |
| 4,421,173 | 12/1983 | Beakley et al. | 175/5 X |
| 4,423,983 | 1/1984 | Dadiras et al. | 405/195 |
| 4,449,854 | 5/1984 | Nayler | 405/195 |

*Primary Examiner*—David H. Corbin

*Attorney, Agent, or Firm*—Richard K. Thomson

[57] ABSTRACT

A tensioner system for a riser of a subsea production well. A plurality of at least three tensioners are each pivotally secured to both a lower surface of the production platform and to a tensioner ring that is itself secured to the riser. The tensioner ring may be generally octagonal with arms protruding from alternate faces of the octagon. These arms define the connecting points for the tensioners. The tensioners are angulated with respect to the axis of the riser, converging toward a single point lying on that axis and defining a first angle. The arms preferably form a second angle with respect to the body of the tensioner ring that is equal to said first angle so that the reaction surface defined by the bottom of the arms is perpendicular to the force lines along which the tensioners act. The failure of one of the tensioners will not result in unbalanced forces that could produce bending torsion, as occurred with previous designs.

13 Claims, 4 Drawing Sheets

METHOD AND APPARATUS FOR TENSIONING A RISER

This application is a continuation-in-part of application Ser. No. 936,579, filed 12/1/86, now U.S. Pat. No. 4,733,991.

BACKGROUND AND SUMMARY OF THE INVENTION

The present invention relates to a method and apparatus for connecting a well on the ocean floor with a wellhead "Christmas" tree, (i.e., the flow control valves) on a fixed or relatively fixed platform, such as a floating tension leg platform, or the like. More particularly, the present invention relates to a method and apparatus used in connecting a riser tensioner system between the riser and the relatively fixed platform so that pairing of tensioners is unnecessary to avoid torsional loading of the riser in the event of failure of one of the tension cylinders.

One of the benefits of a tension leg platform over other floating systems is the very small vertical oscillation that occurs. This enables the welhead trees to be mounted within a few feet of a platform deck without the need for some complex form of motion compensation system. However, the use of a rigid riser system requires that a riser tensioner system be employed to compensate for the small amount of platform movement that does take place so that buckling or bending of the riser under its own weight will not result in a failure (cracking, breaking, etc.) of the riser. Heretofore, tensioner cylinders have typically been paired so as to disable the opposite cylinder when one tensioner cylinder failed and thereby avoid unbalanced loading that can torque the riser and produce the failure of the riser the tensioning system is trying to avoid.

The present invention provides the desired motion compensation and tensioning of the riser by angulating each of the plurality of tensioner cylinders to operate through a common point lying along the centerline of the riser below the point of connection to the platform. The piston rod of each cylinder is connected to a tensioner ring that is in turn clamped to the riser. The tensioner ring has a plurality of arms each of which receives a piston rod, extending from its body at an angle that is generally equivalent to the average angle (i.e., the midpoint extension of the piston rod) that the respective tensioner forms with the riser. In this manner, the tensioner ring arm provides a reaction surface that is generally perpendicular to the action line of force exerted on the riser which lies along the piston cylinder and piston rod. By this configuration, the cylinders need not be hydraulically paired in opposing couples. Failure of one cylinder will not result in any torsional forces that are perpendicular to the longitudinal axis of the riser being applied to it, as occurred with many prior art tensioners.

Various other features, advantages and characteristics of the present invention will become apparent after a reading of the following specification.

DETAILED DESCRIPTION OF THE PREFERRED EMBODIMENT

Figure 1:
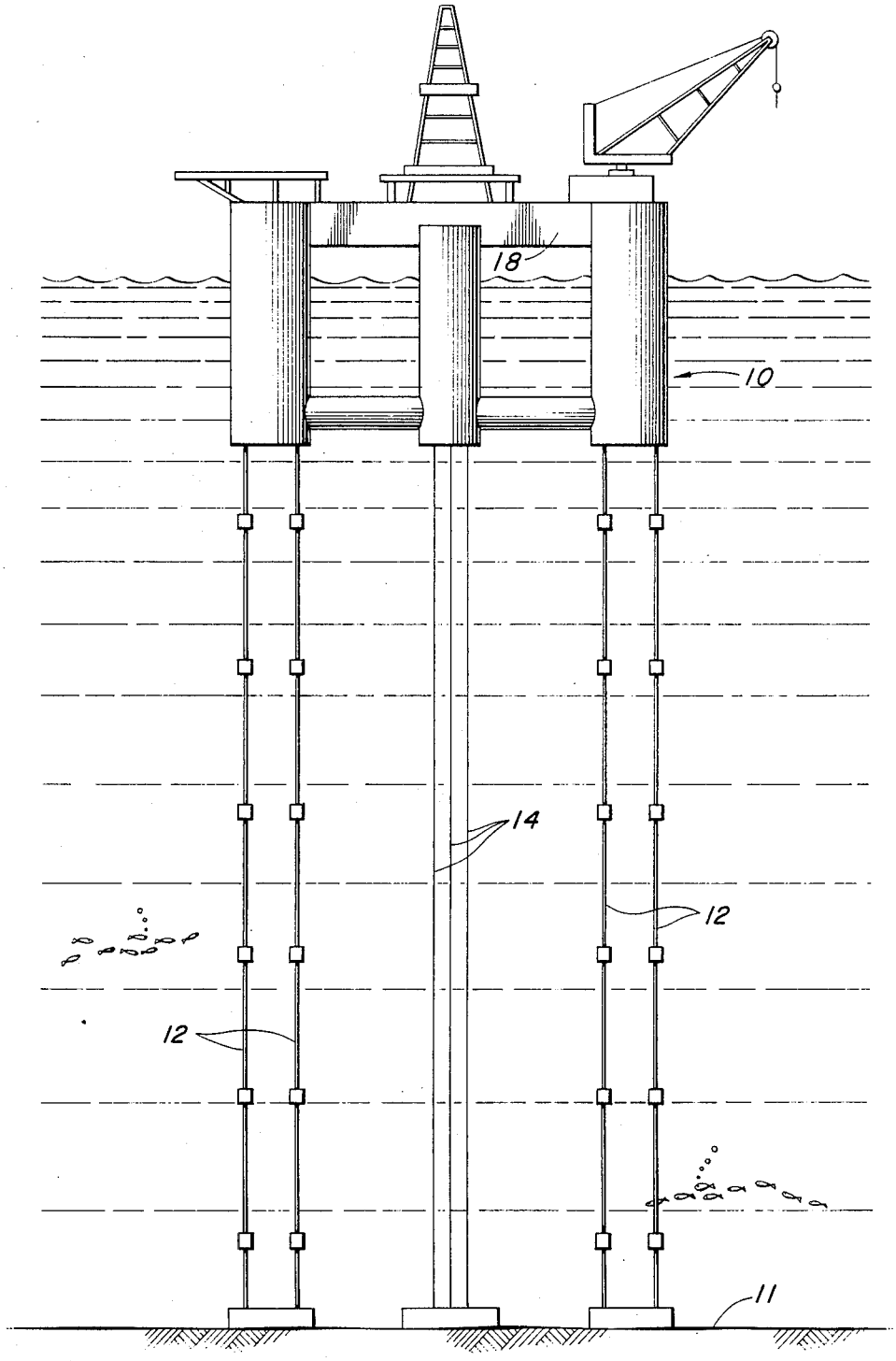
FIG. 1 is a schematic elevational view of a tension leg platform secured in position with production risers connected thereto.

A tension leg platform is shown in FIG. 1 generally at 10. While the riser tensioner of the present invention is peculiarly designed for use with a tension leg platform, it will be appreciated that such a tensioner might be utilized with other fixed and relatively fixed (i.e., floating systems with minimal vertical motion) platforms, as well.

Figure 2:
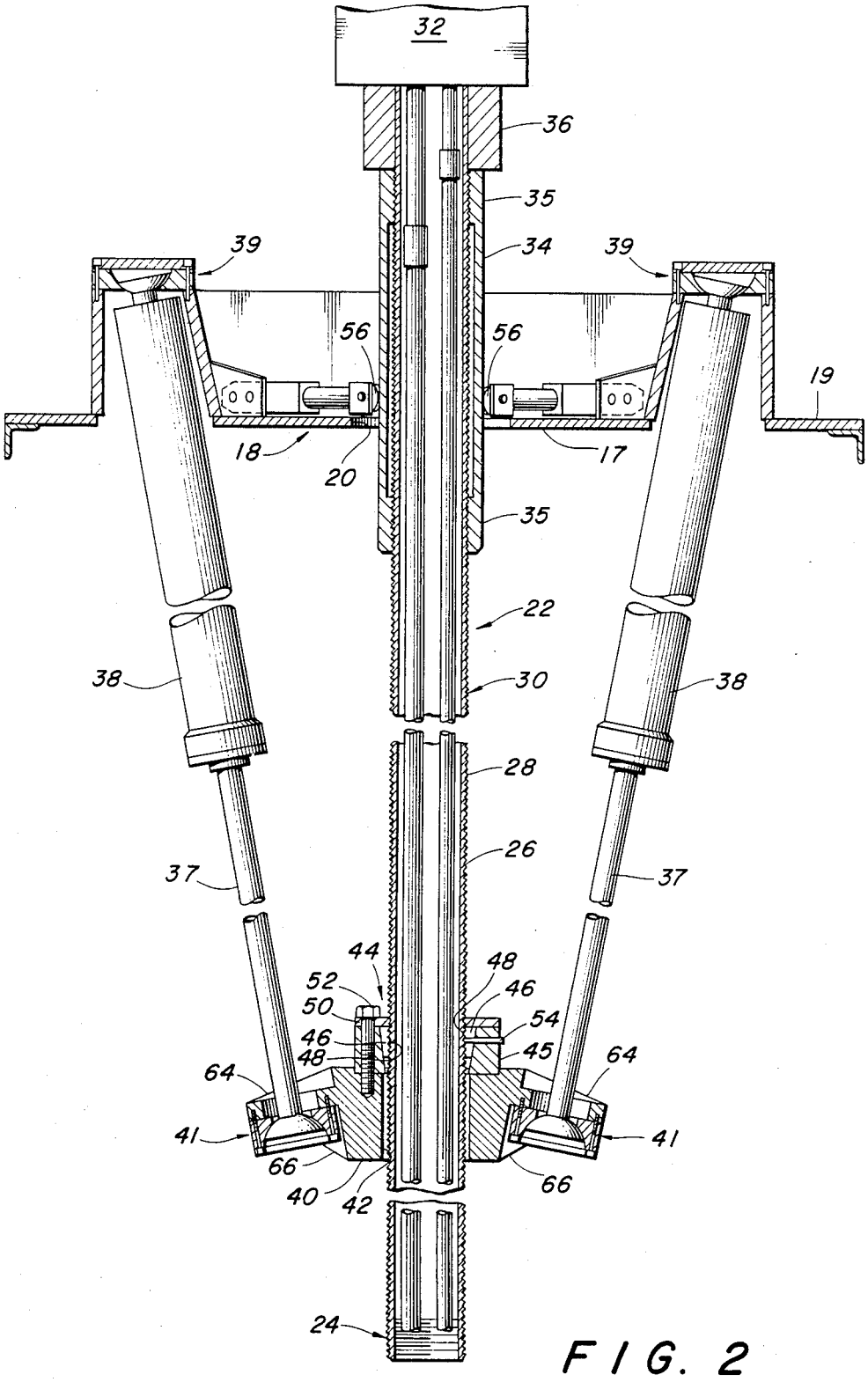
FIG. 2 is a schematic side view of a first preferred embodiment of the riser tensioner attachment ring of the present invention showing its usage with a tension leg platform.

Platform 10 is secured to the ocean floor 11 by a plurality of tendons 12. A plurality of risers 14 extend between the individual wells in template 16 and a wellhead deck 18 of platform 10. As seen in FIG. 2, riser 14 extends through a hole 20 in deck 18 that permits some relative motion between the deck 18 and riser 14 that occurs as a result of wave action on the platform 10.

One form of a riser top joint with which the present invention may be used is depicted in FIG. 2 generally at 22. Lower end 24 is internally threaded to connect with standard riser joint in a conventional manner. Note, although a straight-walled thread is depicted, a tapered thread may be used if desired. The internal diameter of section 22 is to be the same as any other riser section in the particular string 14. The first outer diameter 26 will match that of the remainder of the riser. However, a second outer diameter is formed by a plurality of generally annular protrusions 28 that are generally equally spaced. In the top joint shown in FIG. 2, generally cylindrical protrusions 28 are formed by a continuous helical groove 30 formed on the outer surface of riser top joint 22.

Figure 3:
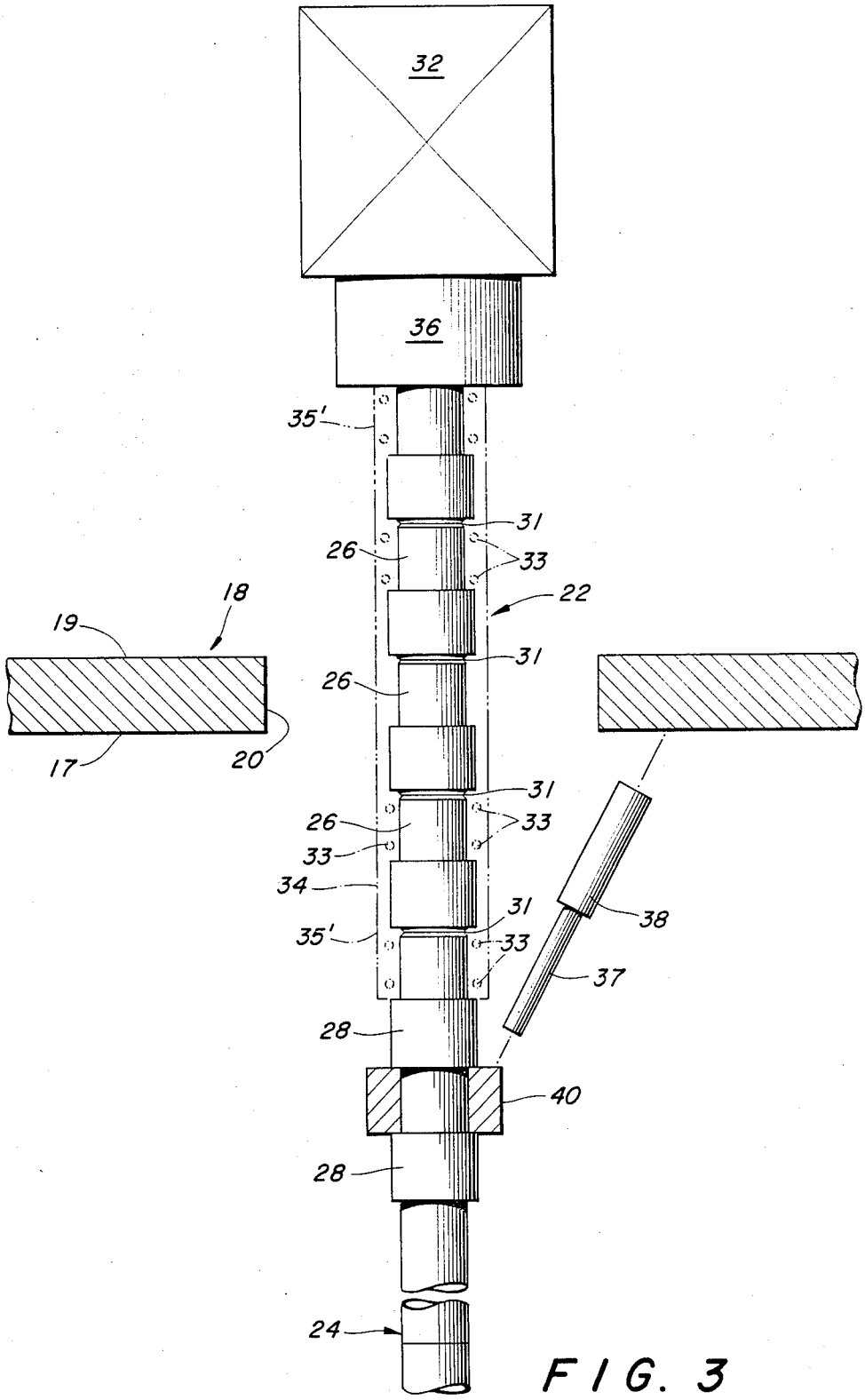
FIG. 3 is a schematic side view of a second type of the riser top joint with which the present invention may be used.

An alternate top joint configuration is depicted in FIG. 3. In this configuration, annular protrusions 28 are formed as cylindrical protrusions of a specified length and particular spacing rather than as a continuous helical groove. These design characteristics (length and spacing) will be selected in accordance with the particular needs of the application such as tensioner load parameters, accuracy of water depth measurement, etc. The surface of the riser may be scored as at 31 adjacent the bottom of each protrusion 28 for reasons to become apparent hereinafter.

In both the FIG. 2 and the FIG. 3 top joint configurations, top joint 22 extends through hole 20 in such a manner that a first plurality of annular protrusions 28 extend above the top surface 19 of deck 18 while a second plurality extend below the bottom surface 17 of the deck 18. The first plurality of protrusions 28 serve as a plurality of connection points for well tree 32. Well tree 32 may be attached at any of the potential connection points by cutting off excess length of the riser guided initially by a thread groove or by the appropriate score line 31, installing either a unitary or a split segmented collar 34 at a position spaced from the top end of the riser top joint, attaching well tree 32 to the top end of joint 22 and positioning packoff 36 upon collar 34. With respect to the utilization of the embodiment employing helical groove 30, the top 4 to 8 turns of the groove will be machined off after the riser joint has been cut to length so packoff 36 will have a smooth surface to engage.

The second plurality of protrusions 28 below the lower surface 17 of the deck 18 provide a series of connection points for a second unitary or split collar tensioner ring 40 which in turn, is a connector for a series of riser tensioners 38. While any type of riser tensioner may be used, user tensioners 38 are preferably of the pneumatic-hydraulic variety described and clamined in U.S. Pat. No. 4,379,657, which is hereby incorporated by reference. Note, however, the paired cylinder concept employed within said patent has been made unnecessary by angling the riser tensioners 38, and hence the action lines for the load forces so that those lines pass through the center line of the riser eliminating torsion loading. Therefore, each cylinder 38 will have its own set of air and hydraulic accumulators (not shown) with the oil accumulator connected to the rod side of the piston and the air accumulator connected to the oil accumulator as described in said patent.

Figure 5:
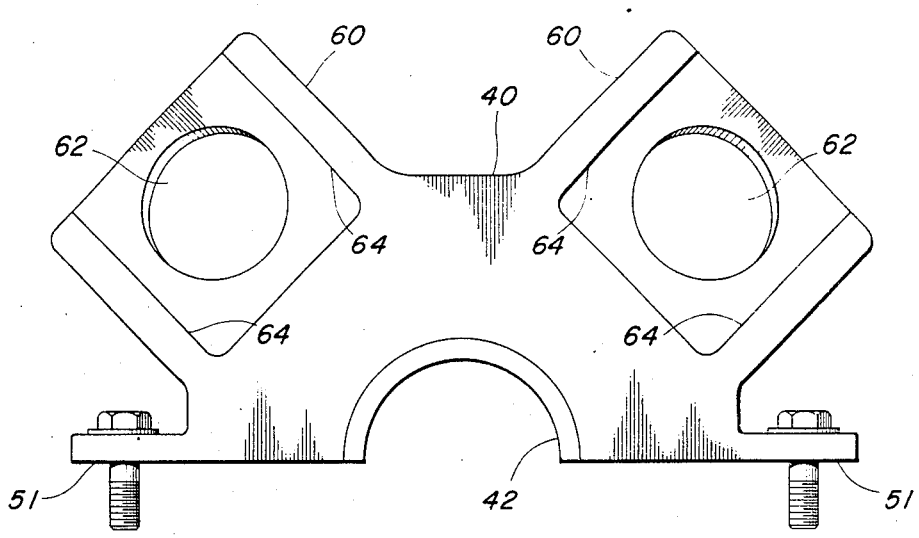
FIG. 5 is a top view of one segment of the split segmented riser tensioner ring used with the type riser top joint shown in FIG. 3.
Figure 4:
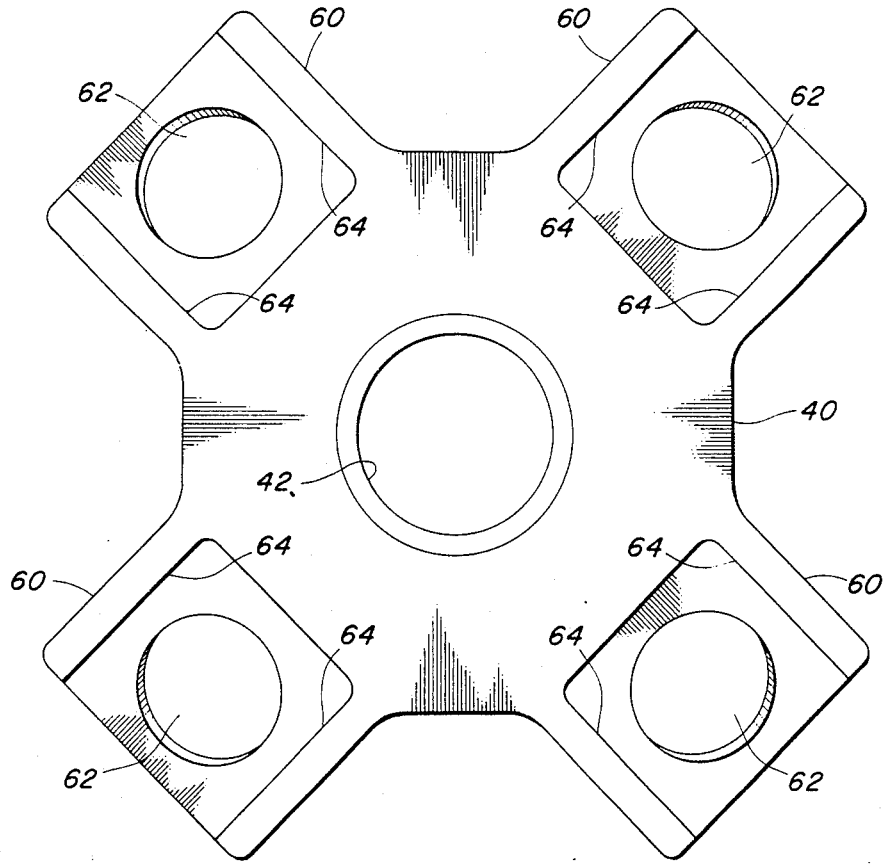
FIG. 4 is a top view of the unitary tensioner ring used in the FIG. 2 embodiment.

The unitary designed collar 40 shown in FIG. 4 is preferably used with the FIG. 2 embodiment while the split segmented collar design of FIG. 5 is more appropriate with the FIG. 3 configuration. The configuration of the riser tensioners 38, collar 40 and deck 20 of the FIG. 3 embodiment are substantially identical to the FIG. 2 device and, accordingly have been shown schematically, depicting only the differences between the two embodiments.

The unitary design tensioner ring 40 shown in FIGS. 2 and 4 has a throughbore 42 of sufficient diameter to clear the outer diameter of spiral groove 30. As best seen in FIG. 4, ring tensioner 40 has a generally octagonal body with mounting arms 60 extending from alternate faces of the octagon. Each arm 60 has an opening 62 to receive the end of piston arm 37 and is provided with upper (64) and lower (66) reinforcing webs to strengthen ring 40. Each of these arms 60 is angulated somewhat with respect to the plane of the rest of the body (see FIG. 2) and preferably forms an angle equal to the average angle the riser tensioner 38 forms with centerline of riser 14. In this manner, the plane of each arm 60 will form a reaction surface that is generally perpendicular to line of force acting along the centerline of the tension cylinder 38 and rod 37. While this angle will be a function of design (length of tensioners, diameter of ring, point of cylinder attachment, etc), these angles will generally fall in the range of from about 10° to about 25°. Since each of the plurality of tensioners 38 acts through a common point, should one cylinder fail, there is no tendency to torque or bend the riser as was the case with previous configurations. Hence, there is no need to pair the operation of opposed cylinders and each tensioner 38 will be independently provided with its own hydraulic and air reservoirs (not shown). While any number of tensioners 38 can be used, it is preferred that a minimum of three be used (in which event the body of the ring 40 would preferably be hexagonal) and, more preferably, a minimum of four.

A conventional slip mechanism 44 comprised of camming ring 45, wedges 46 with internally arcuate, threaded surfaces 48 and a clamping plate 50, is bolted to tensioner ring 40 by a plurality (one shown) of securing bolts 52. Camming ring 45 forces wedges 46 into engagement with spiral groove 30 and clamping plate 50 holds the wedges 46 in engaged position. A lateral pin 54 can be utilized to prevent relative rotation between camming ring 45 and wedges 46 and, hence, between tensioner ring 40 and top joint 22.

The split segment tensioner ring 40 of the FIG. 3 embodiment is shown in FIG. 5. The details of the configuration are similar with this alternate design being formed with two flanges 51 to permit the segments to be bolted together. As depicted schematically in FIG. 3, the inner diameter of opening 42 conforms generally to base diameter 26 to facilitate its connection to the stepwise variable riser top joint embodiment.

Lateral stabilizing rollers 56 engage the external surface of collar 34 to keep the riser 14 centered within opening 20. In the FIG. 2 embodiment only a short portion 35 at each end of collar 34 is full thickness (i.e., has a minimum internal diameter) and is threaded to engage the spiral groove 30 of top joint 22. In the FIG. 3 embodiment, sections 35' are full thickness to fill the spaces between annular protrusions 28 and one section of split segment collar 34 is tapped as at 33 to receive connecting bolts (not shown) counter sunk in the other split segment. This provides a smooth external surface for stabilizing roller 56 to engage and facilitates their operation.

The four riser tensioners 38 (two shown) are each interconnected to the platform deck 18 by a modified ball-and-socket joint 39 that permits some rotational movement between the tensioner 38 and deck 18 that will occur as the piston arm 37 of tensioner 38 extends and retracts to maintain a uniform tension on riser 14. A similar modified ball-and-socket connection 41 is used to connect the ends of piston arms 37 to tensioner ring 40 to permit the same rotational motion between tensioners 38 and tensioner ring 40. It will, of course, be appreciated that any number of riser tensioners 38 may be used.

The riser tensioner system of the present invention provides a greatly simplified means of tensioning a production riser 14 without subjecting it to unbalanced forces that could lead to bending or breaking of the riser or production tubing contained within. The tensioner ring provides a plurality (three or more) of connecting points in arms 60 that is equal to the number of tensioner cylinders 38 to be used. The arms 60 preferably are each angled with respect to the plane of body portion of the ring 40 with the specified angle being equal to the angle formed between the tensioner and the riser so the reaction surfaces formed thereby will be generally perpendicular to the action lines of force for tensioners 38. In the event of failure of one of the system's tensioners, the system will continue to operate effectively and no extraordinary effort need be made to replace the inoperative tensioner. Rather, the defective part may be replaced when it becomes convenient (e.g., after a storm has passed).

Various changes, alternatives and modifications will become apparent following a reading of the foregoing specification. Accordingly, it is intended that all such changes, alternatives and modifications as come within the scope of the appended claims be considered part of the present invention.

We claim:

1. A tensioner system for tensioning a riser from a producing subsea well and for compensating for relative movement between said riser and a production platform, said riser having a longitudinal axis, said apparatus comprising:

a plurality of at least three riser tensioners interconnected between said platform and said riser, each said tensioner comprising a piston cylinder arrangement with a rod-mounted piston slidably mounted therein;

a tensioner ring surrounding a portion of said riser and having a plurality of attachment points for connecting said tensioners at a first radial distance from said riser, said plurality of attachment points being equal in number to said plurality of tensioners;

means for securing said tensioner ring to said riser;

means for pivotally attaching an end of each of said tensioners to one of said attachment points;

means for pivotally attaching a second end of each of said tensioners to said platform at a point above said tensioner ring at a second radial distance greater than said first;

whereby said piston cylinders, with said piston rods in their median position, act along force lines which define a first angle with respect to said riser and which pass through a common point lying along the longitudinal axis of said riser such that failure of one of said tensioners will not result in torsional forces being applied to said riser by the tensioner system.

2. The riser tensioner of claim 1 wherein said attachment points comprise a plurality of arms extending substantially radially from said tensioner ring.

3. The riser tensioner system of claim 2 wherein said tensioner ring comprises a generally octagonal body lying in a first plane with said arms extending from alternate faces of said octagonal body.

4. The riser tensioner system of claim 3 wherein each of the arms of said tensioner ring lies in a separate plane different from said octagonal body, each said separate plane defining a second angle with respect to said first plane of said body.

5. The riser tensioner system of claim 4 wherein said first and second angles are generally equal such that reaction surfaces defined by said arms are substantially perpendicular to said force lines.

6. The riser tensioner system of claim 2 wherein the arms of said tensioners ring lie in separate planes different from a body portion of said tensioner ring, each said separate plane defining a second angle with respect to a first plane defined by said body portion of said tensioner ring.

7. The riser tensioner system of claim 6 wherein said first and second angles are generally equal such that reaction surfaces defined by said arms are substantially perpendicular to said force lines.

8. The riser tensioner system of claim 7 wherein said first and second angles fall in the range from about 10° to about 25°.

9. The riser tensioner of claim 1 wherein said first angle falls in the range form about 10° to about 25°.

10. The riser tensioner system of claim 1 wherein said tensioner ring has a throughbore which has a diameter greater than a maximum diameter of said riser.

11. The riser tensioner system of claim 1 wherein said tensioner ring has a throughbore that is slightly greater than a first diameter of said riser but less than a second larger diameter.

12. The riser tensioner system of claim 11 wherein said tensioner ring is formed of two identical halves with flanges to enable the halves to be bolted together around said first diameter.

13. A method of tensioning a production riser which extends from a subsea well to a production platform to compensate for relative motion between said riser and said platform, said method comprising:

pivotally securing a first end of each of a first plurality of at least three tensioners to said platform at a first radial distance relative to said riser so that said tensioners extend in a generally downwardly direction;

securing a tensioner ring which has a second plurality of connecting points at a second radial distance less than the first from said riser, said second plurality being equal in number to said first plurality;

pivotally connecting a second end of each of said plurality of said tensioners to one of said connecting points of said tensioner ring;

whereby said tensioners act along forcelines which generally converge to a single point lying along a longitudinal axis of said riser such that, in the event one of said tensioners fails, said riser will not be subjected torsional bending by the remaining tensioners.

* * * * *